US009661925B2

(12) United States Patent
Uffner

(10) Patent No.: US 9,661,925 B2
(45) Date of Patent: May 30, 2017

(54) SELF-POSITIONING DRAWER SLIDE

(71) Applicant: Gary H. Uffner, Corona, NY (US)

(72) Inventor: Gary H. Uffner, Corona, NY (US)

( * ) Notice: Subject to any disclaimer, the term of this patent is extended or adjusted under 35 U.S.C. 154(b) by 0 days.

(21) Appl. No.: 14/953,778

(22) Filed: Nov. 30, 2015

(65) Prior Publication Data

US 2016/0157607 A1 Jun. 9, 2016

Related U.S. Application Data

(60) Provisional application No. 62/088,955, filed on Dec. 8, 2014.

(51) Int. Cl.

| | |
|---|---|
| ***A47B 95/00*** | (2006.01) |
| ***A47B 88/10*** | (2006.01) |
| ***A47B 88/427*** | (2017.01) |
| ***A47B 88/43*** | (2017.01) |
| ***A47B 88/493*** | (2017.01) |

(52) U.S. Cl.

CPC ..... *A47B 88/10* (2013.01); *A47B 88/427* (2017.01); *A47B 88/43* (2017.01); *A47B 88/493* (2017.01); *A47B 2210/0016* (2013.01); *A47B 2210/0032* (2013.01)

(58) Field of Classification Search

CPC . A47B 88/0477; A47B 88/0481; A47B 88/08; A47B 88/16; A47B 88/0466; A47B 88/0407; A47B 88/14; A47B 88/10; A47B 88/43; A47B 88/427; A47B 88/493; A47B 2210/0016; A47B 2210/0032; E05B 65/463

See application file for complete search history.

(56) References Cited

U.S. PATENT DOCUMENTS

| | | | | | |
|---|---|---|---|---|---|
| 3,033,638 | A * | 5/1962 | Tomlinson | A47B 88/08 | 312/334.8 |
| 3,133,768 | A * | 5/1964 | Klakovich | A47B 88/08 | 312/323 |
| 4,469,384 | A * | 9/1984 | Fler | A47B 88/10 | 312/333 |
| 4,610,487 | A * | 9/1986 | Delmege | A47B 88/16 | 384/18 |
| 4,696,582 | A * | 9/1987 | Kasten | A47B 88/10 | 384/18 |
| 5,507,571 | A * | 4/1996 | Hoffman | A47B 88/10 | 312/334.16 |
| 6,244,678 | B1 * | 6/2001 | Dopp | A47B 88/047 | 312/333 |
| 6,435,636 | B1 * | 8/2002 | MacMillan | A47B 88/047 | 312/333 |
| 6,830,300 | B2 * | 12/2004 | Lauchner | H05K 7/1421 | 312/223.1 |

(Continued)

*Primary Examiner* — Hanh V Tran

(57) ABSTRACT

A self-positioning drawer slide designed to secure a drawer for a recreational vehicle (RV) from opening unintentionally during transit. The self-positioning drawer slide includes a plurality of slide members, a latching fixture, and a catching fixture. The drawer is connected to the interior of the cabinet through the plurality of slide members. The latching fixture selectively engages the catching fixture to secure the drawer within the cabinet. The plurality of slides includes a first edge mounting tab and a second edge mounting tab which fasten to a vertical support of the cabinet to further support the present invention and prevent give or play between the present invention and the cabinet.

14 Claims, 10 Drawing Sheets

(56) References Cited

U.S. PATENT DOCUMENTS 7,281,694 B2 * 10/2007 Allen ..... A47B 88/044 211/183
7,357,362 B2 * 4/2008 Yang ..... A47B 88/044 248/220.22
7,364,244 B2 * 4/2008 Sandoval ..... H05K 7/1411 312/333
7,731,142 B2 * 6/2010 Chen ..... A47B 88/044 248/244
7,798,582 B2 * 9/2010 Yu ..... A47B 88/044 211/26
8,353,494 B2 * 1/2013 Peng ..... A47B 88/044 211/192
8,371,454 B2 * 2/2013 Chen ..... A47B 88/044 211/26
2001/0040203 A1 * 11/2001 Brock ..... A47B 88/044 248/222.11
2002/0175605 A1 * 11/2002 Chen ..... A47B 88/14 312/333
2003/0209958 A1 * 11/2003 Hwang ..... A47B 88/08 312/334.46
2003/0209959 A1 * 11/2003 Shih-Long ..... A47B 88/08 312/334.46
2004/0174102 A1 * 9/2004 Chen ..... A47B 88/14 312/334.46
2006/0091771 A1 * 5/2006 Teskey ..... A47B 88/08 312/334.44
2009/0284115 A1 * 11/2009 Huang ..... A47B 88/16 312/334.44
2012/0169199 A1 * 7/2012 Chen ..... A47B 88/16 312/334.44
2012/0187816 A1 * 7/2012 Chen ..... E05B 65/463 312/334.8
2013/0077900 A1 * 3/2013 Lowe ..... A47B 88/10 384/18

* cited by examiner

SELF-POSITIONING DRAWER SLIDE

The current application claims a priority to the U.S. Provisional Patent application Ser. No. 62/088,955 filed on Dec. 8, 2014.

FIELD OF THE INVENTION

The present invention relates generally to a drawer slide. More specifically, the present invention relates to a drawer slide which integrates a latching mechanism in order to prevent unintentional opening of a drawer, as well as, extensions to secure the drawer slide into place.

BACKGROUND OF THE INVENTION

Cabinet and cabinet drawers can be built from a variety of materials and with many different manufacturing processes which often depend on the setting in which they are used. Traditional American cabinets or face frame cabinets fix the frame to the front of the cabinet carcass and provide a fixing point for doors, drawers, and other external hardware. Drawer slides generally comprise two primary outer rails that attach to the cabinet and drawer, as well as other inner rails and sub components that work to improve performance and provide both structural and dynamic stability.

Cabinet drawers are often found in recreational vehicles (RV's) or campers in order to store a multitude of objects such as silverware, camping equipment, and more. It becomes problematic if these drawers slide open when RV's are riding on the street or other terrains due to the various forces acted upon and within the vehicle. Inventors have developed catching devices that attach to slides in order to prevent drawers from sliding open in undesirable circumstances, however, these mechanisms are separate from the sliders themselves and must be adjusted to a certain force in order to function properly. Another problem arises when fastening screws that connect sliders to drawers and cabinets loosen. These pieces come loose due to longitudinal forces produced from the aforementioned RV's movement, as well as when users open and close drawers.

It is therefore an objective of the present invention to introduce a self-positioning drawer slide with a catching fixture, a latching fixture, a first edge mounting tab and a second edge mounting tab. The self-positioning drawer slide is designed such that the catching fixture and the latching fixture engage each other to secure a drawer from sliding out from a cabinet structure. The first edge mounting tab and the second edge mounting tab provide additional support for the present invention onto the cabinet structure over traditional drawer mounts.

DETAIL DESCRIPTIONS OF THE INVENTION

All illustrations of the drawings are for the purpose of describing selected versions of the present invention and are not intended to limit the scope of the present invention.

The present invention is a self-positioning drawer slide designed to restrict the motion of the drawer without intentional force from the user. The present invention is intended to be implemented within cabinets for recreational vehicles (RV's); however the present invention has applications with toolbox drawers, dressers, tables, etc. The present invention prevents the drawer from unintentionally opening from turning, braking, or quick acceleration while an RV is in transit.

Figure 1:
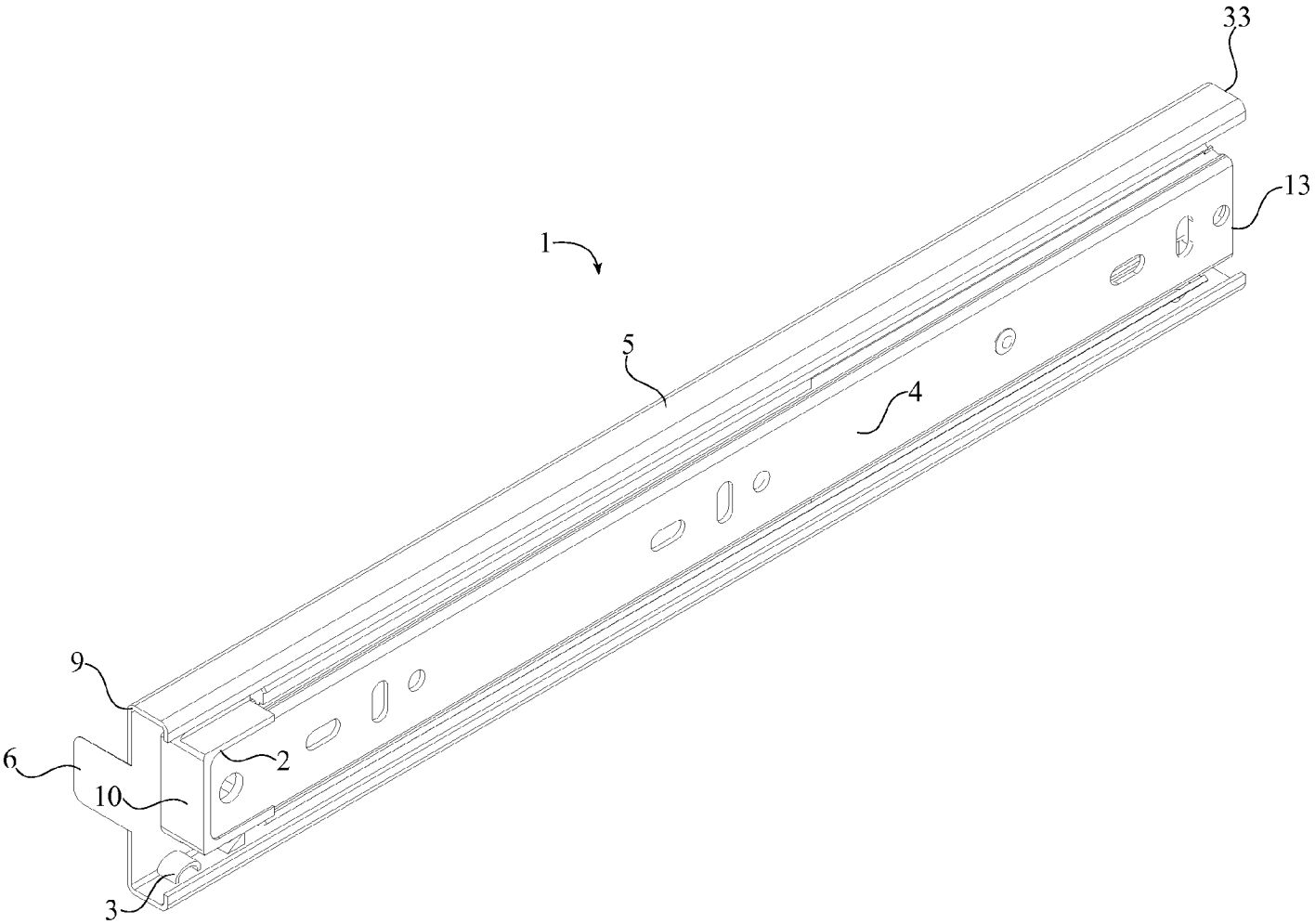
FIG. 1 is a front perspective view of the present invention where the drawer mounting member is recessed into the support mounting member.

The present invention comprises a plurality of slide members 1, a latching fixture 2 and a catching fixture 3, as shown in FIG. 1. The plurality of slide members 1 allows a drawer to selectively extend out from a cabinet as well as being positioned within the cabinet. The catching fixture 3 selectively engages the latching fixture 2 such that the user is able to open and close the drawer as desired. The plurality of slide members 1 comprises a drawer mounting member 4 and a support mounting member 5. The drawer mounting member 4 is mounted onto the drawer in order to support the drawer within the cabinet. Similarly, the support mounting member 5 is mounted onto the interior of a cabinet attaching and supporting the drawer to the cabinet. The plurality of slide members 1 is serially and telescopically engaged to each other. More specifically, the drawer mounting member 4 is adjacently and slidably engaged with the support mounting member 5 in order to allow the drawer to extend out from and recede into the cabinet.

Figure 2:
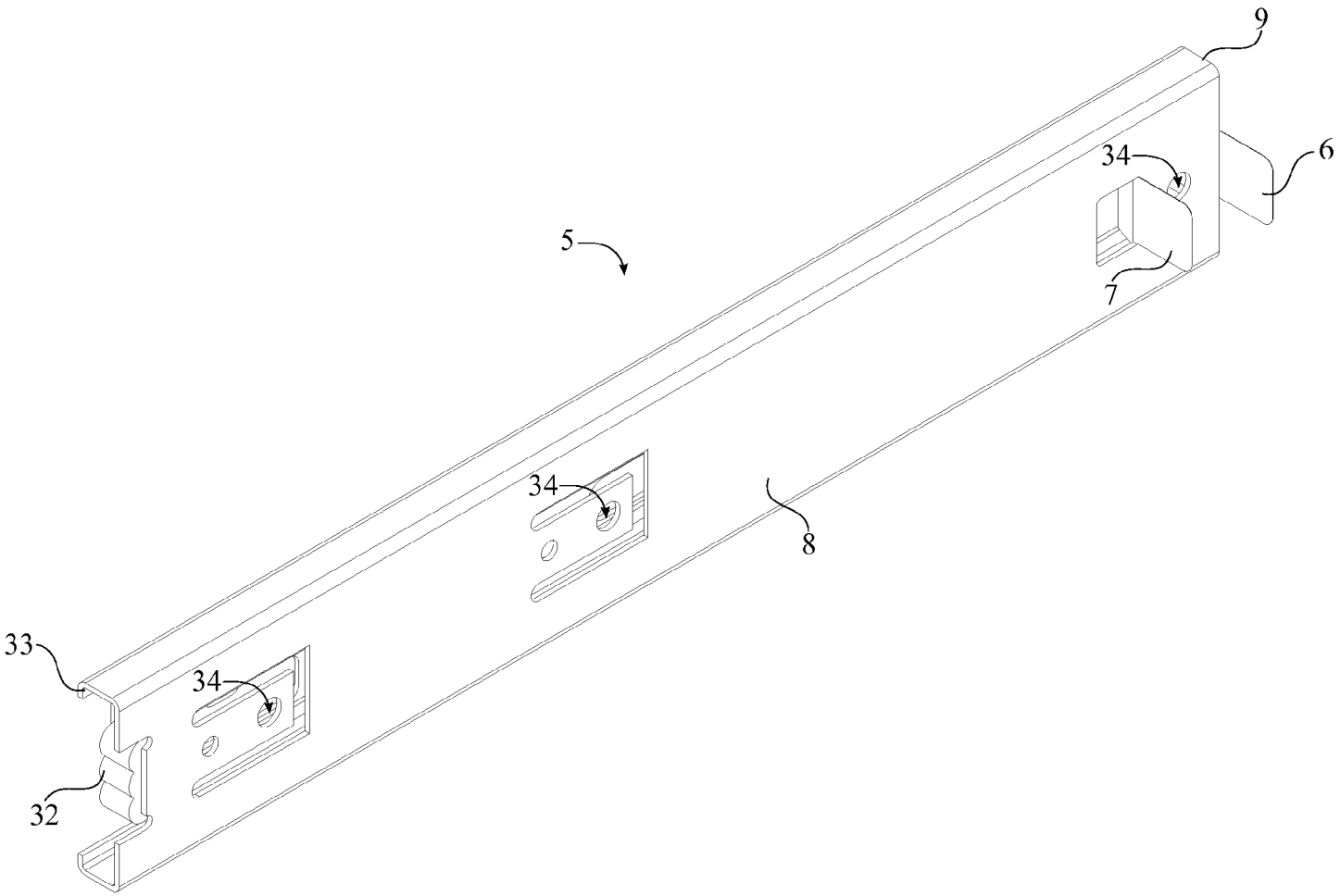
FIG. 2 is a rear perspective view of the present invention.

In accordance to the preferred embodiment, the support mounting member 5 comprises a first edge mounting tab 6, a second edge mounting tab 7, a support mounting plate 8, and a receiving end 9, as shown in FIG. 2. The first edge mounting tab 6 and the second edge mounting tab 7 securely affix the present invention to the front of the cabinet in order to reduce play or give between the present invention and the cabinet. The support mounting plate 8 is the interface of the present invention and the cabinet which the present invention is mounted through. The first edge mounting tab 6 is perpendicularly and adjacently connected to the support mounting plate 8, opposite to the drawer mounting member 4. Similarly, the second edge mounting tab 7 is perpendicularly and adjacently connected to the support mounting plate 8, opposite to the drawer mounting member 4. The receiving end 9 is an end of the support mounting member 5 which other members of the plurality of slide members 1 traverses through as the drawer extends out from the cabinet. The first edge mounting tab 6 is positioned adjacent to the receiving end 9. The second edge mounting tab 7 is positioned offset from the first edge mounting tab 6. In implementation, the first edge mounting tab 6 and the second edge mounting tab 7 are positioned around a vertical support of the cabinet and then fastened to the vertical support to improve the attachment of drawer on the cabinet through the present invention.

Figure 3:
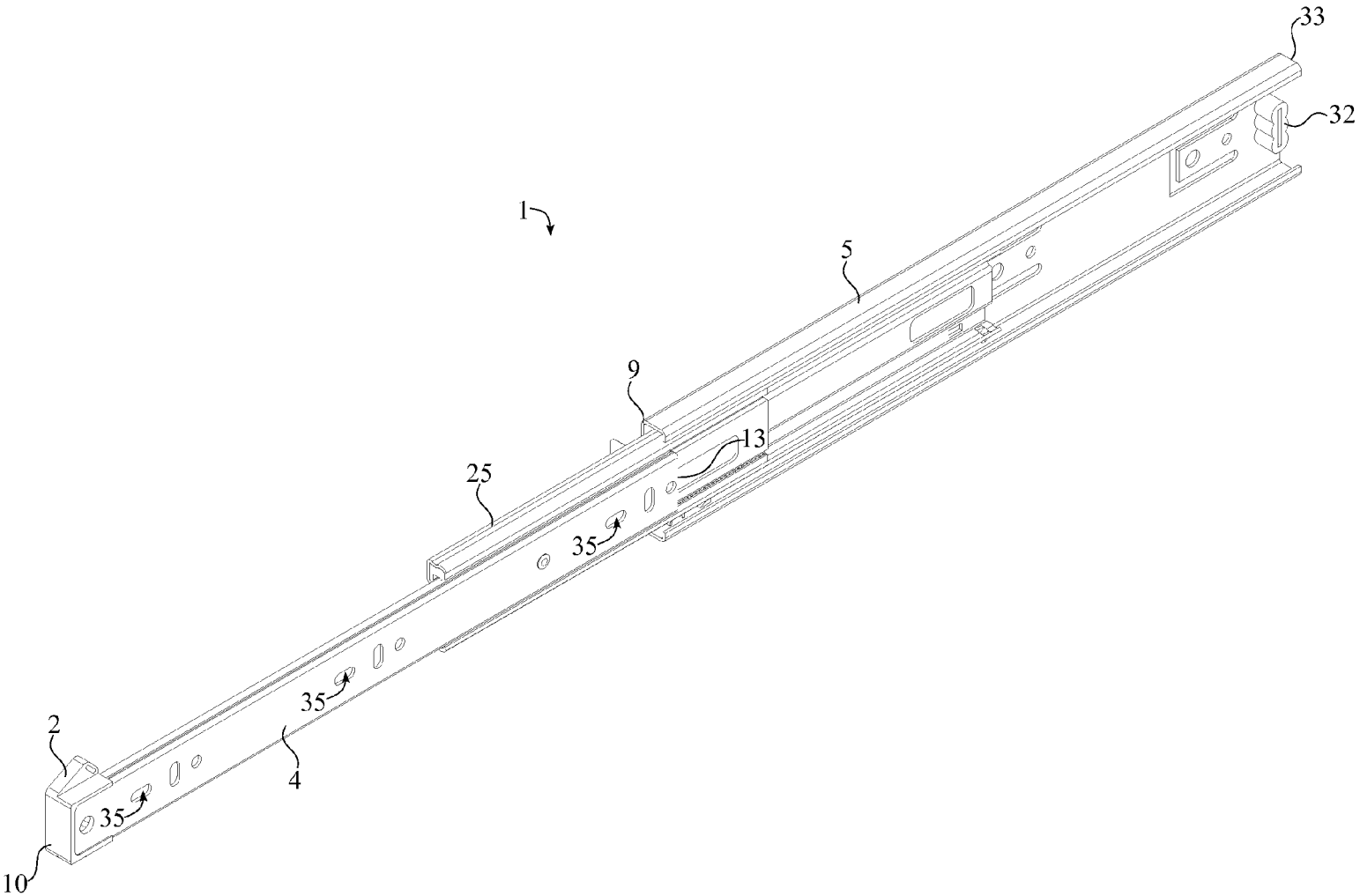
FIG. 3 is a front perspective view of the present invention where the drawer mounting member is extended from the support mounting member.
Figure 5:
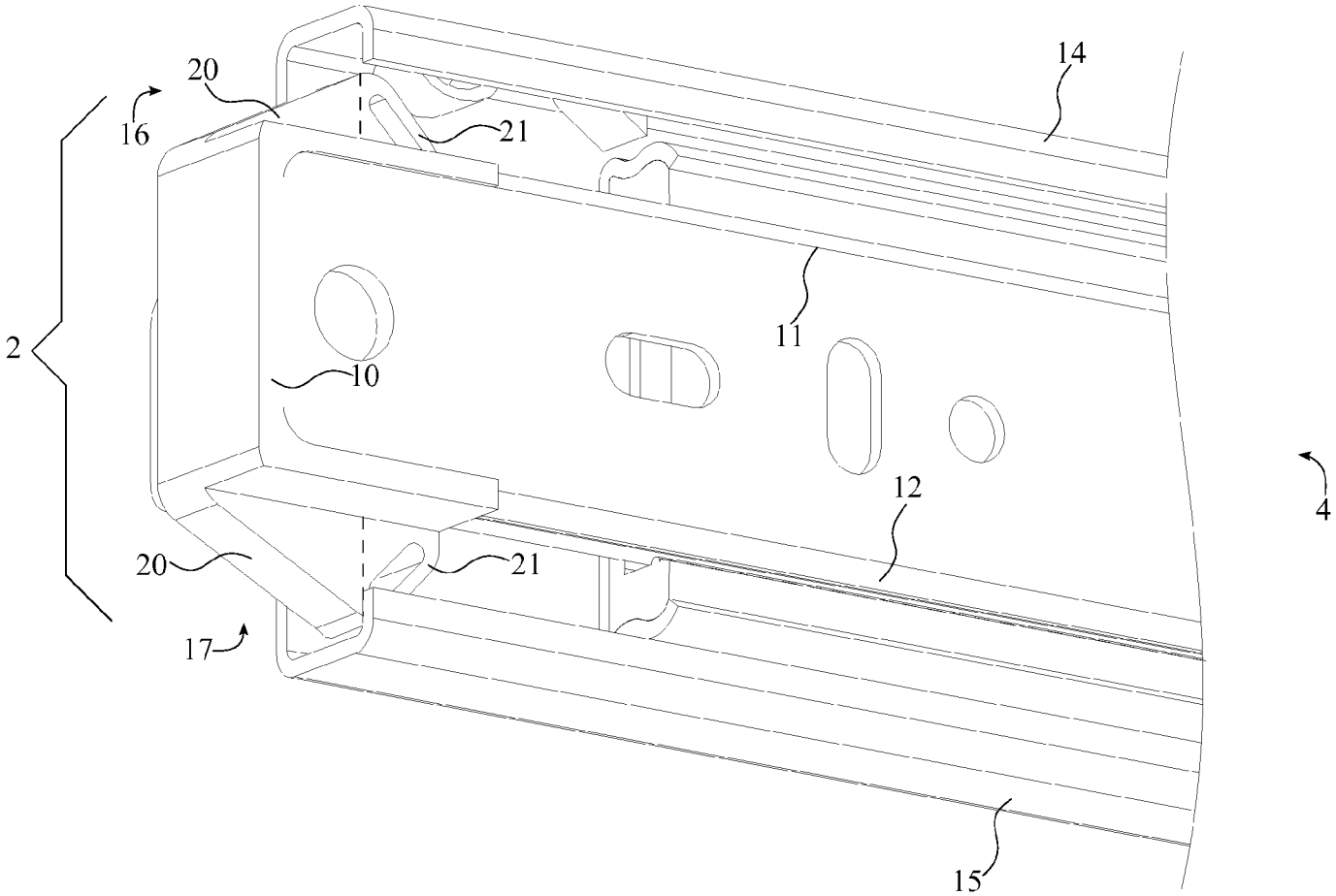
FIG. 5 is a detailed view of the receiving end of the support mounting member and the distal end of the drawer mounting member as the latching fixture is disengaged with the catching fixture

In accordance to FIG. 3 and FIG. 5, the drawer mounting member 4 comprises a distal end 10, which the latching fixture 2 is connected. The distal end 10 is an end of the drawer mounting member 4 adjacent to a drawer face of the drawer. The latching fixture 2 is integrated into the drawer mounting member 4, adjacent to the distal end 10, such that the latching fixture 2 engages the catching fixture 3 when the drawer is positioned within the cabinet. The catching fixture 3 is integrated into the support mounting member 5, adjacent to the receiving end 9 in order to engage the latching fixture 2 as the drawer is positioned within the cabinet.

More specifically in accordance to the preferred embodiment, the drawer mounting member 4 further comprises an upper interface 11, a lower interface 12, a drawer mounting plate 24, and a proximal end 13. Similarly, the support mounting member 5 further comprises an upper track 14 and a lower track 15. In some embodiments of the present invention shown in FIG. 7, the plurality of slide members 1 comprises at least one intermediary member 25. The at least one intermediary member 25 allows the drawer to extend farther from the cabinet. The drawer mounting member 4 is slidably engaged to the at least one intermediary member 25. The at least one intermediary member 25 is slidably engaged to the support mounting member 5. Thus, the drawer mounting member 4 is engaged to the support mounting member 5 through the at least one intermediary member 25.

Figure 4:
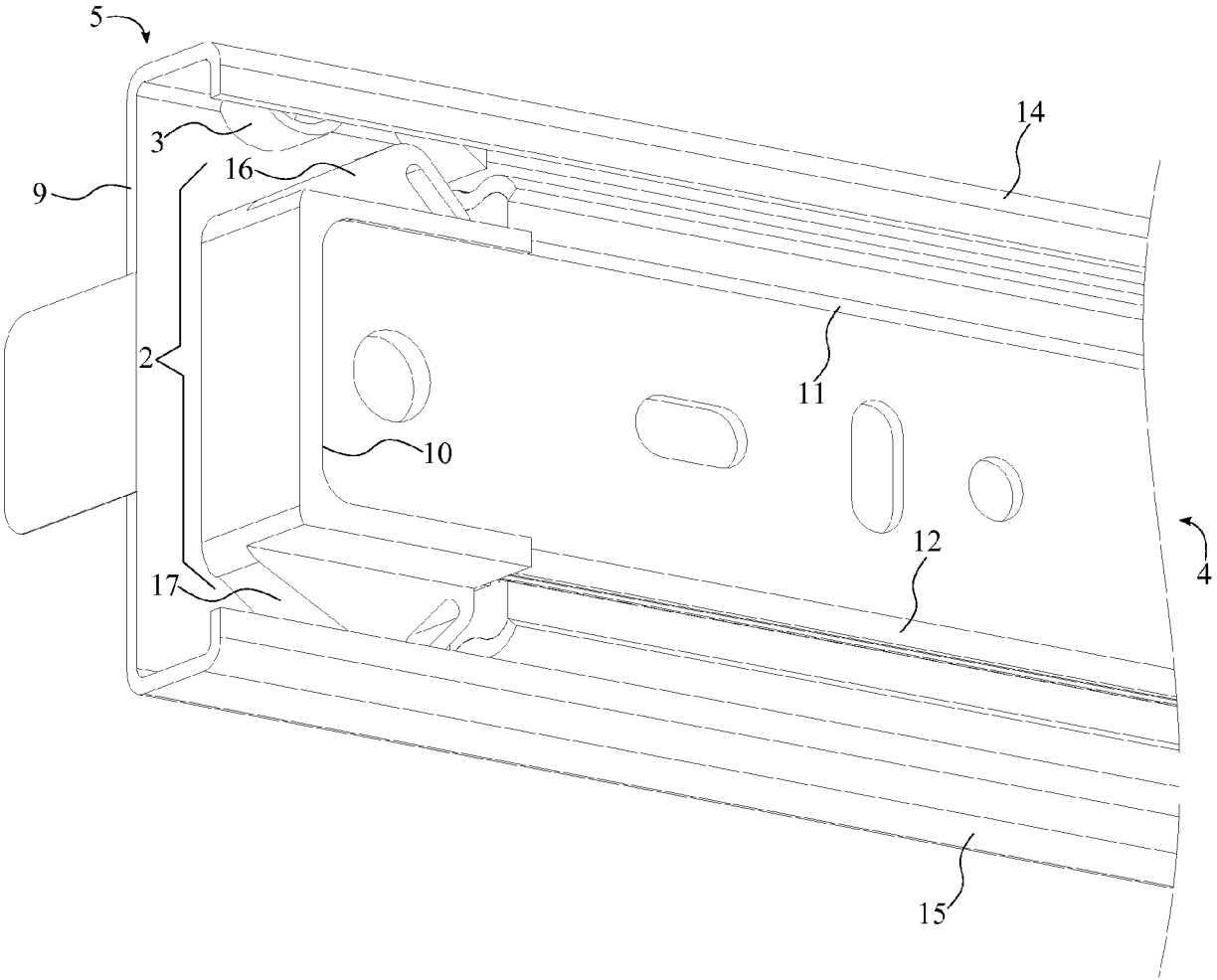
FIG. 4 is a detailed view of the receiving end of the support mounting member and the distal end of the drawer mounting member as the drawer mounting member is recessed within the support mounting member.

As detailed in FIG. 4, the upper interface 11 and the lower interface 12 allow the drawer mounting member 4 to be slidably connected to the at least one intermediary member 25 or to the support mounting member 5. The upper interface 11 is perpendicularly and adjacently connected to the drawer mounting plate 24. The lower interface 12 is perpendicularly and adjacently connected to the drawer mounting plate 24. The upper interface 11 and the lower interface 12 are positioned opposite to each other across the drawer mounting member 4 in order to interface and secure the drawer mounting member 4 with the at least one intermediary member 25 or the support mounting member 5, while allowing for the slidable connection. Similarly, the upper track 14 and the lower track 15 allow the support mounting member 5 to be slidably connected to the at least one intermediary member 25 or to the drawer mounting member 4. The upper track 14 and the lower track 15 are perpendicularly and adjacently connected to the support mounting plate 8. The upper track 14 and the lower track 15 are positioned opposite to each other across the support mounting member 5 in order to interface and secure the at least one intermediary member 25 or the drawer mounting member 4 with the support mounting member 5. The upper track 14 and the lower track 15 allow the at least one intermediary member 25 or the support mounting member 5 to slide within the support mounting member 5. The distal end 10 and the proximal end 13 are positioned opposite to each other along the drawer mounting member 4, such that the proximal end 13 is adjacent to the receiving end 9 as the drawer is pulled away from the cabinet.

Further in accordance to the preferred embodiment and FIG. 4, the catching fixture 3 is integrated between the upper track 14 and the lower track 15, adjacent to the receiving end 9. The latching fixture 2 laterally extends from the upper interface 11 and the lower interface 12, adjacent to the distal end 10, such that the latching fixture 2 engages the catching fixture 3 as the drawer is positioned within the cabinet.

More specifically shown in FIG. 5, the latching fixture 2 comprises a first extrusion 16 and a second extrusion 17. The first extrusion 16 of the latching fixture 2 is connected adjacent to the upper interface 11. Similarly, the second extrusion 17 of the latching fixture 2 is connected adjacent to the lower interface 12. The first extrusion 16 and the second extrusion 17 of the latching fixture 2 are oriented away from each other, such that the latching fixture 2 engages the catching fixture 3 on opposite sides of the latching fixture 2. Thus, the first extrusion 16 and the second extrusion 17 of the latching fixture 2 provide additional resistance to incidental extension when the drawer is positioned within the cabinet. Additionally, the first extrusion 16 and the second extrusion 17 of the latching fixture 2 each comprise a shallow sloped portion 20 and a steep sloped portion 21. The shallow sloped portion 20 is positioned adjacent to the distal end 10, while the steep sloped portion 21 is positioned adjacent to the shallow sloped portion 20, opposite to the distal end 10. This configuration for the first extrusion 16 and the second extrusion 17 allows the latching fixture 2 to be easily engage and disengage the catching fixture 3.

Figure 6:
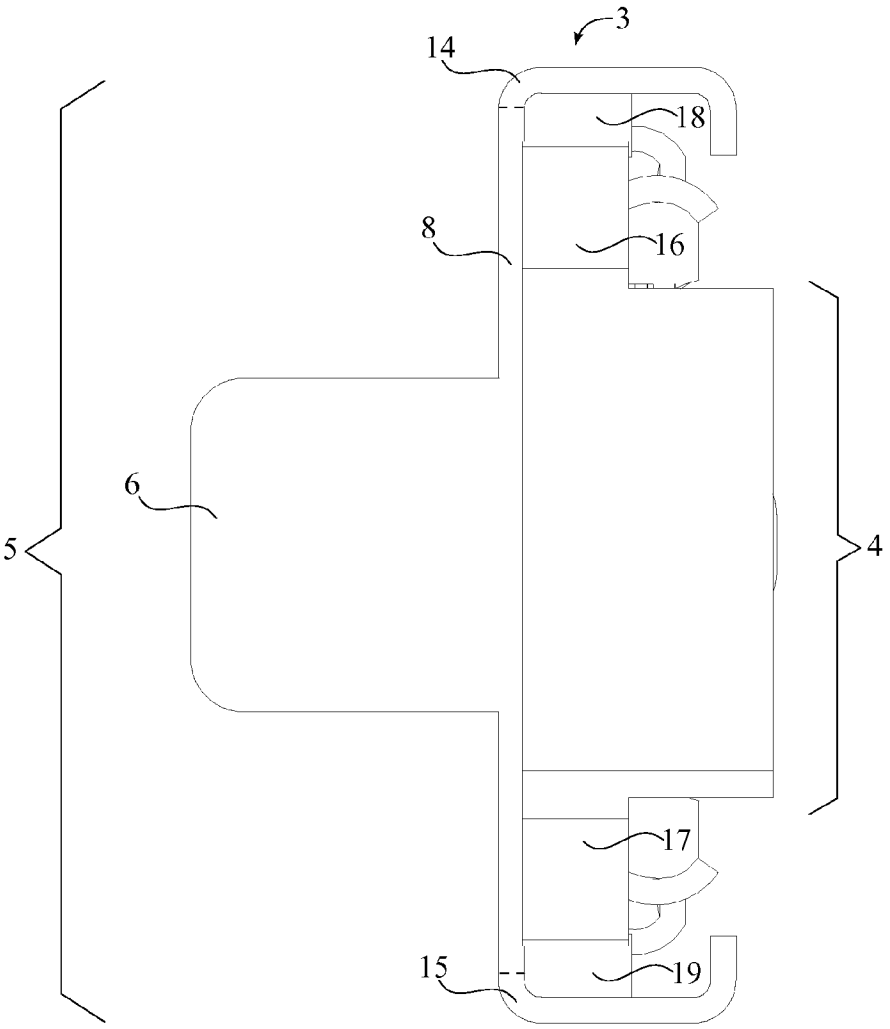
FIG. 6 is a front view of the present invention.

In accordance to FIG. 6, the catching fixture 3 comprises a first extrusion 18 and a second extrusion 19. The first extrusion 18 of the catching fixture 3 is connected adjacent to the upper track 14, and the second extrusion 19 of the catching fixture 3 is connected adjacent to the lower track 15. The first extrusion 18 and the second extrusion 19 of the catching fixture 3 are oriented toward each other. This configuration allows the first extrusion 18 of the catching fixture 3 to engage with the first extrusion 16 of the latching fixture 2 while the second extrusion 19 of the catching fixture 3 to engage with the second extrusion 17 of the latching fixture 2. In some embodiments of the present invention, the first extrusion 18 and the second extrusion 19 of the catching fixture 3 each comprise a shallow sloped portion and a steep sloped portion. The shallow sloped portion is positioned adjacent to the receiving end 9. The steep portion is positioned adjacent to the shallow sloped portion, opposite to the receiving end 9. The inclusion of the shallow sloped portion and the steep sloped portion in this manner allows the latching fixture 2 to easily engage as the drawer is pushed into the cabinet, but restricts the drawer from unintentionally opening while an RV is in transit.

Figure 7:
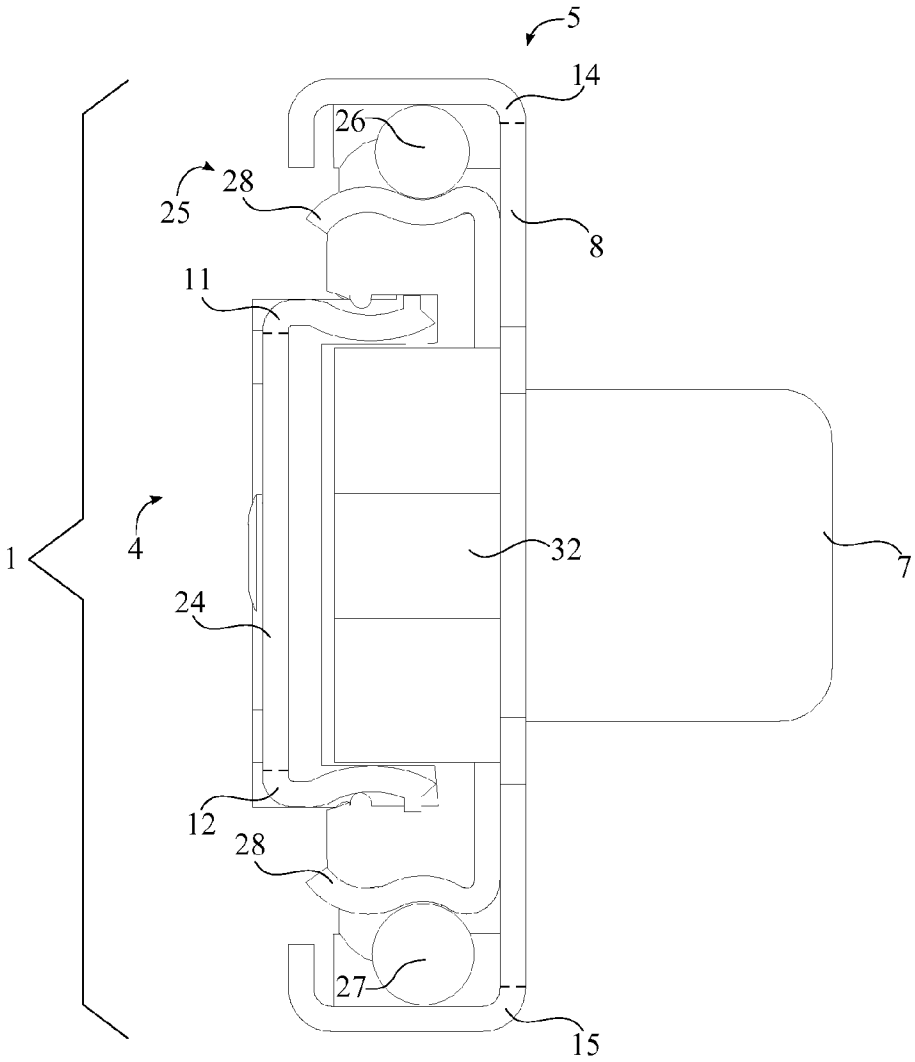
FIG. 7 is a rear view of the present invention.

In accordance to the preferred embodiment, the present invention comprises a first series of ball bearings 26 and a second series of ball bearings 27 in order to facilitate the slidable connection between each component of the plurality of slide members 1. In some embodiments which comprise the at least one intermediary member 25, the at least one intermediary member 25 comprises a first intermediary member 28, as shown in FIG. 7. The first intermediary member 28 is a member within the plurality of slide members 1 which interfaces with the support mounting member 5 but is not the drawer mounting member 4. The first series of ball bearings 26 is rotatably mounted along the first intermediary member 28. The second series of ball bearings 27 is rotatably mounted along the first intermediary member 28, opposite the first series of ball bearings 26. The first intermediary member 28 is slidably engaged to the support mounting member 5 through the first series of ball bearings 26 and the second series of ball bearings 27, reducing friction between the first intermediary member 28 and the support mounting member 5.

Figure 8:
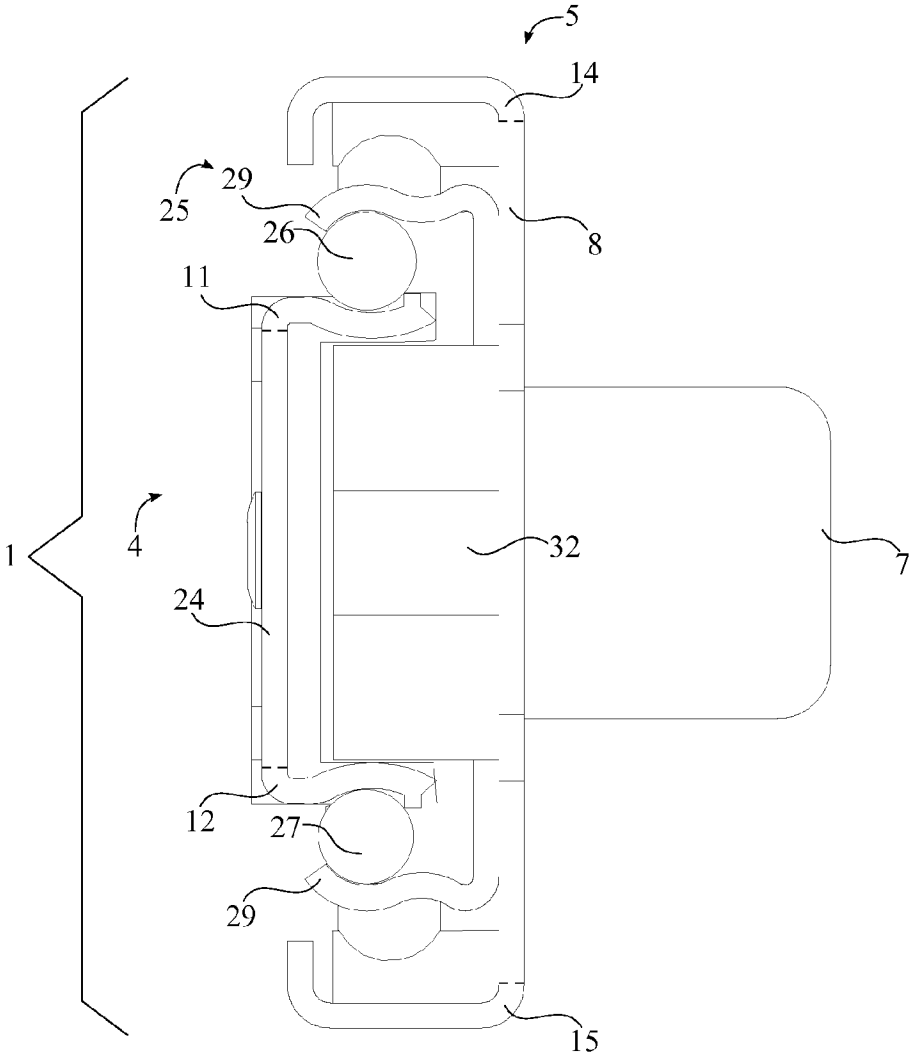
FIG. 8 is a rear view of the present invention detailing an embodiment for the plurality of slide members which includes a first intermediary member and a last intermediary member.

In some embodiments comprising at least one intermediary member 25, the at least one intermediary member 25 comprises a last intermediary member 29, in accordance to FIG. 8. The last intermediary member 29 is a member of the plurality of slide members 1 which interfaces with the drawer mounting member 4 but is not the support mounting member 5. The first series of ball bearings 26 is rotatably mounted along the drawer mounting member 4. The second series of ball bearings 27 is rotatably mounted along the drawer mounting member 4, opposite the first series of ball bearings 26. The last intermediary member 29 is slidably engaged to the drawer mounting member 4 through the first series of ball bearings 26 and the second series of ball bearings 27, reducing friction between the last intermediary member 29 and the drawer mounting member 4.

Figure 9:
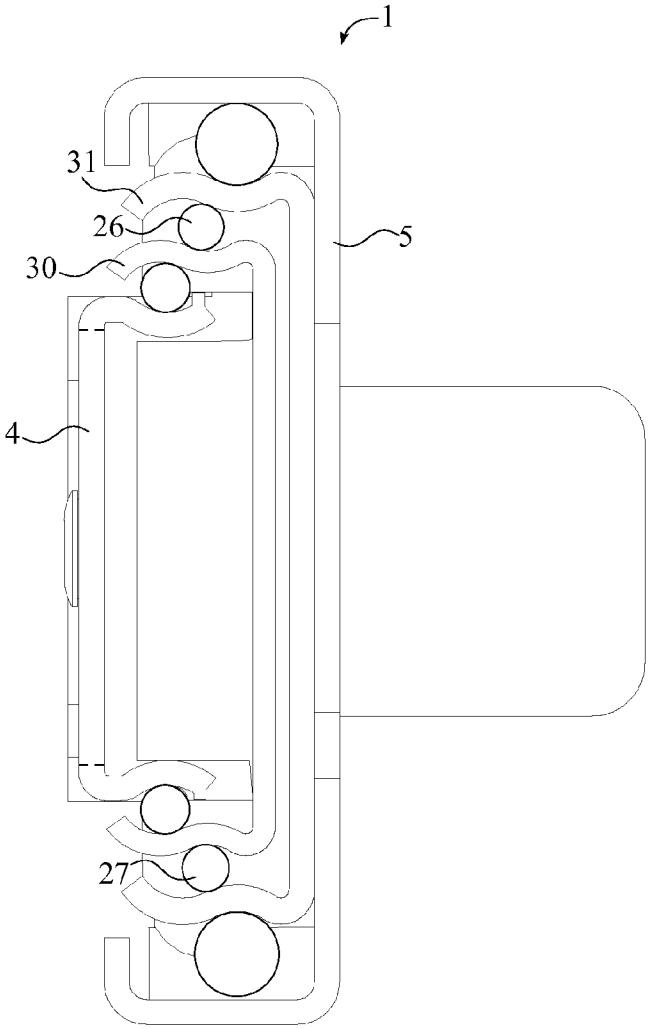
FIG. 9 is a rear view of the present invention detailing an embodiment for the plurality of slide members which includes an arbitrary intermediary member and an antecedent intermediary member.

In some other embodiments comprising at least one intermediary member 25, the at least one intermediary member 25 comprises an arbitrary intermediary member 30, and an antecedent intermediary member 31, as detailed in FIG. 9. The arbitrary intermediary member 30 is a member of the plurality of slide members 1 that does not include the support mounting member 5 and the drawer mounting member 4. The antecedent intermediary member 31 is similar to the arbitrary intermediary member 30, however the antecedent intermediary member 31 is a member of the plurality of slide members 1 which precedes the arbitrary intermediary member 30 in a series of the plurality of slide members 1. The first series of ball bearings 26 is rotatably mounted along the arbitrary intermediary member 30. The second series of ball bearings 27 is rotatably mounted along the arbitrary intermediary member 30, opposite the first series of ball bearings 26. The arbitrary intermediary member 30 is slidably engaged to the antecedent intermediary member 31 through the first series of ball bearings 26 and the second series of ball bearings 27, in order to reduce friction between the arbitrary intermediary member 30 and the antecedent intermediary member 31.

Figure 10:
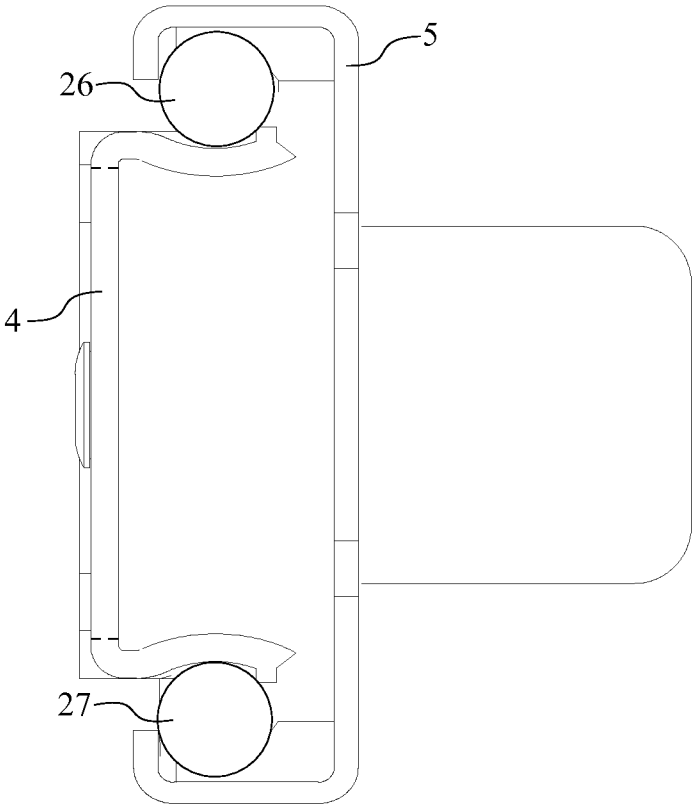
FIG. 10 is a rear view of the present invention detailing an embodiment wherein the plurality of slide members simply includes the drawer mounting member and the support mounting member.

In some embodiments of the present invention show in FIG. 10, the first series of ball bearings 26 is rotatably mounted along the drawer mounting member 4. The second series of ball bearings 27 are rotatably mounted along the drawer mounting member 4, opposite the first series of ball bearings 26. The drawer mounting member 4 is slidably engaged to the support mounting member 5 through the first series of ball bearings 26 and the second series of ball bearings 27, reducing friction between the drawer mounting member 4 and the support mounting member 5.

In accordance to the preferred embodiment, FIG. 2, and FIG. 3, the present invention comprises a rear stop 32. The support mounting member 5 comprises a terminal end 33. The receiving end 9 and the terminal end 33 are positioned opposite to each other along the support mounting member 5. The rear stop 32 is perpendicularly connected to the support mounting member 5. The rear stop 32 is positioned adjacent to the terminal end 33 in order to prevent members of the plurality of slide members 1 other than the support mounting member 5 from traversing through the terminal end 33.

In order to mount the present invention onto the interior of a cabinet, the support mounting member 5 comprises a plurality of support mounting holes 34, shown in FIG. 2. The plurality of support mounting holes 34 allows nails, screws, or similar fasteners to secure the present invention to the interior of the cabinet. The plurality of support mounting holes 34 is distributed along the support mounting member 5 in order to distribute the weight of the drawer and drawer contents to the cabinet. The plurality of support mounting holes 34 traverses through the support mounting member 5 in order to allow fasteners to secure the present invention onto the interior of the cabinet.

Similarly, the drawer mounting member 4 comprises a plurality of drawer mounting holes 35 in order to mount the present invention to the drawer, as shown in FIG. 3. The plurality of drawer mounting holes 35 is distributed along the drawer mounting member 4 in order to distribute the weight of the drawer and drawer contents across the interior of the cabinet. The plurality of drawer mounting holes 35 traverses though the drawer mounting member 4 in order to allow fasteners to secure the present invention to the drawer.

Although the invention has been explained in relation to its preferred embodiment, it is to be understood that many other possible modifications and variations can be made without departing from the spirit and scope of the invention as hereinafter claimed.

What is claimed is:

1. A self-positioning drawer slide comprising:
a plurality of slide members;
a latching fixture;
a catching fixture;
the plurality of slide members comprising a drawer mounting member and a support mounting member;
the support mounting member comprising a first edge mounting tab, a second edge mounting tab, a support mounting plate, a receiving end and a terminal end;
the receiving end and the terminal end being positioned opposite to each other along the support mounting member;
the drawer mounting member comprising a distal end and a proximal end;
the distal end and the proximal end being positioned opposite to each other along the drawer mounting member;
the receiving end and the distal end corresponding to each other;
the terminal end and the proximal end corresponding to each other;
the plurality of slide members being serially and telescopically engaged to each other;
the drawer mounting member being adjacently and slidably engaged with the support mounting member;
the first edge mounting tab being perpendicularly and adjacently connected to the support mounting plate, opposite to the drawer mounting member;
the first edge mounting tab being positioned adjacent to the receiving end;
the second edge mounting tab being perpendicularly and adjacently connected to the support mounting plate, opposite to the drawer mounting member;
the second edge mounting tab being positioned offset from the first edge mounting tab;
the catching fixture being integrated into the support mounting member, adjacent to the receiving end;
the latching fixture being integrated into the drawer mounting member, adjacent to the distal end;
the catching fixture being selectively engaged by the latching fixture;
the latching fixture comprising a latching extrusion;
the latching extrusion comprising a shallow sloped latching portion and a steep sloped latching portion;

the shallow sloped latching portion and the steep sloped latching portion being positioned adjacent to each other;

the shallow sloped latching portion being positioned towards the distal end;

the steep sloped latching portion being positioned towards the proximal end;

the catching fixture comprising a catching extrusion;

the catching extrusion comprising a shallow sloped catching portion and a steep sloped catching portion;

the shallow sloped catching portion and the steep sloped catching portion being positioned adjacent to each other;

the shallow sloped catching portion being positioned towards the receiving end;

the steep sloped catching portion being positioned towards the terminal end;

the shallow sloped latching portion and the steep sloped catching portion corresponding to each other and being configured to be engaged with each other; and the steep sloped latching portion and the shallow sloped catching portion corresponding to each other and being configured to be engaged with each other.

2. The self-positioning drawer slide as claimed in claim 1 comprising:

the drawer mounting member comprising an upper interface and a lower interface;

the support mounting member comprising an upper track and a lower track;

the upper interface and the lower interface being positioned opposite to each other across the drawer mounting member;

the upper track and the lower track being positioned opposite to each other across the support mounting member;

the catching fixture being integrated between the upper track and the lower track, adjacent to the receiving end; and the latching fixture being laterally extending from the upper interface and the lower interface, adjacent to the distal end.

3. The self-positioning drawer slide as claimed in claim 2 comprising:

the latching extrusion comprising a first extrusion and a second extrusion;

the first extrusion and the second extrusion each comprising the shallow sloped latching portion and the steep sloped latching portion;

the first extrusion being connected adjacent to the upper interface;

the second extrusion being connected adjacent to the lower interface; and the first extrusion and the second extrusion being oriented away from each other.

4. The self-positioning drawer slide as claimed in claim 2 comprising:

the catching extrusion comprising a first extrusion and a second extrusion;

the first extrusion and the second extrusion each comprising the shallow sloped catching portion and the steep sloped catching portion;

the first extrusion being connected adjacent to the upper track;

the second extrusion being connected adjacent to the lower track; and the first extrusion and the second extrusion being oriented toward each other.

5. The self-positioning drawer slide as claimed in claim 2 comprising:

the drawer mounting member further comprising a drawer mounting plate;

the upper interface being perpendicularly and adjacently connected to the drawer mounting plate; and the lower interface being perpendicularly and adjacently connected to the drawer mounting plate.

6. The self-positioning drawer slide as claimed in claim 2 comprising:

the upper track being perpendicularly and adjacently connected to the support mounting plate; and the lower track being perpendicularly and adjacently connected to the support mounting plate.

7. The self-positioning drawer slide as claimed in claim 1 comprising:

the plurality of slide members comprising at least one intermediary member;

the drawer mounting member being slidably engaged to the at least one intermediary member; and the at least one intermediary member being slidably engaged to the support mounting member.

8. The self-positioning drawer slide as claimed in claim 7 comprising:

a first series of ball bearings;

a second series of ball bearings;

the at least one intermediary member comprising a first intermediary member;

the first series of ball bearings being rotatably mounted along the first intermediary member;

the second series of ball bearings being rotatably mounted along the first intermediary member, opposite the first series of ball bearings; and the first intermediary member being slidably engaged to the support mounting member through the first series of ball bearings and the second series of ball bearings.

9. The self-positioning drawer slide as claimed in claim 7 comprising:

a first series of ball bearings;

a second series of ball bearings;

the at least one intermediary member comprising a last intermediary member;

the first series of ball bearings being rotatably mounted along the drawer mounting member;

the second series of ball bearings being rotatably mounted along the drawer mounting, opposite the first series of ball bearings; and the drawer mounting member being slidably engaged to the last intermediary member through the first series of ball bearings and the second series of ball bearings.

10. The self-positioning drawer slide as claimed in claim 7 comprising:

a first series of ball bearings;

a second series of ball bearings;

the at least one intermediary member comprising an arbitrary intermediary member and an antecedent intermediary member;

the first series of ball bearings being rotatably mounted along the arbitrary intermediary member;

the second series of ball bearings being rotatably mounted along the arbitrary intermediary member, opposite the first series of ball bearings; and the arbitrary intermediary member being slidably engaged to the antecedent intermediary member through the first series of ball bearings and the second series of ball bearings.

11. The self-positioning drawer slide as claimed in claim 1 comprising:

a first series of ball bearings;

a second series of ball bearings;

the first series of ball bearings being rotatably mounted along the drawer mounting member;

the second series of ball bearings being rotatably mounted along the drawer mounting member, opposite the first series of ball bearings; and the drawer mounting member being slidably engaged to the support mounting member through the first series of ball bearings and the second series of ball bearings.

12. The self-positioning drawer slide as claimed in claim 1 comprising:

a rear stop;

the rear stop being perpendicularly connected to the support mounting member; and the rear stop being positioned adjacent to the terminal end.

13. The self-positioning drawer slide as claimed in claim 1 comprising:

the support mounting member comprising a plurality of support mounting holes;

the plurality of support mounting holes being distributed along the support mounting member; and the plurality of support mounting holes traversing through the support mounting member.

14. The self-positioning drawer slide as claimed in claim 1 comprising:

the drawer mounting member comprising a plurality of drawer mounting holes;

the plurality of drawer mounting holes being distributed along the drawer mounting member; and the plurality of drawer mounting holes traversing through the drawer mounting member.

* * * * *